United States Patent [19]

Hyllberg

[11] 4,364,313

[45] Dec. 21, 1982

[54] IMPRESSION ROLLER WITH ADJUSTABLE ELECTRICAL CHARACTERISTICS AND METHOD OF MAKING THE SAME

[75] Inventor: Bruce E. Hyllberg, Gurnee, Ill.

[73] Assignee: American Roller Company, Union Grove, Wis.

[21] Appl. No.: 296,218

[22] Filed: Aug. 25, 1981

[51] Int. Cl.[3] ..... B41C 1/04; B41F 9/06

[52] U.S. Cl. ..... 101/401.1; 101/153; 101/219; 101/375; 29/829

[58] Field of Search ..... 101/375, 153, 170, 216, 101/219, DIG. 15, 426, 401.1; 29/592 R, 829, 837, 132

[56] References Cited

U.S. PATENT DOCUMENTS 3,447,369 11/1969 Adamson et al. ..... 101/153
3,619,720 11/1971 Coberley ..... 101/153 X
3,625,146 12/1971 Hutchison ..... 101/153
4,099,462 7/1978 Coberley et al. ..... 101/153

*Primary Examiner*—E. H. Eickholt
*Attorney, Agent, or Firm*—Quarles & Brady

[57] ABSTRACT

An impression roller with an insulated core, with an outer layer of resilient semiconductive material, and with a set of conductive wires extending along its length and out one end for interconnection, to adjust the resistance of the roller to current being conducted between a first region of higher potential and a second region of relatively lower potential. In a first embodiment the wires are connected by jumper wires while in a second embodiment resistors are connected between the conductive elements to provide further increments in the adjustment of roller resistance. A method is also disclosed for making such a roller.

9 Claims, 7 Drawing Figures

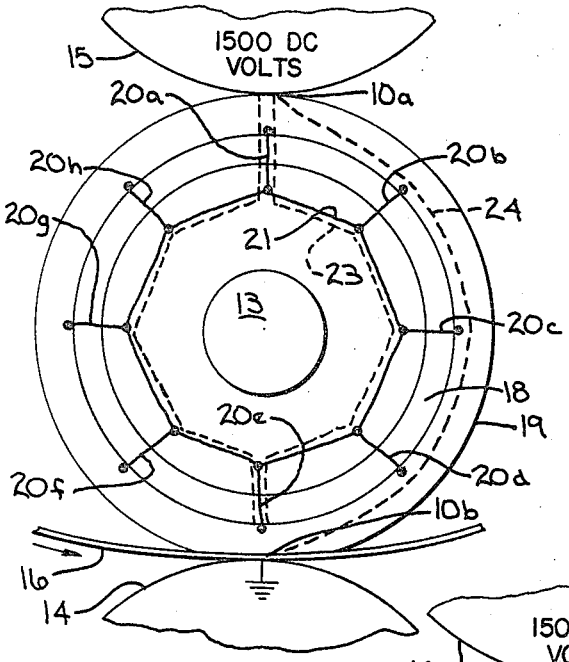
FIG.3
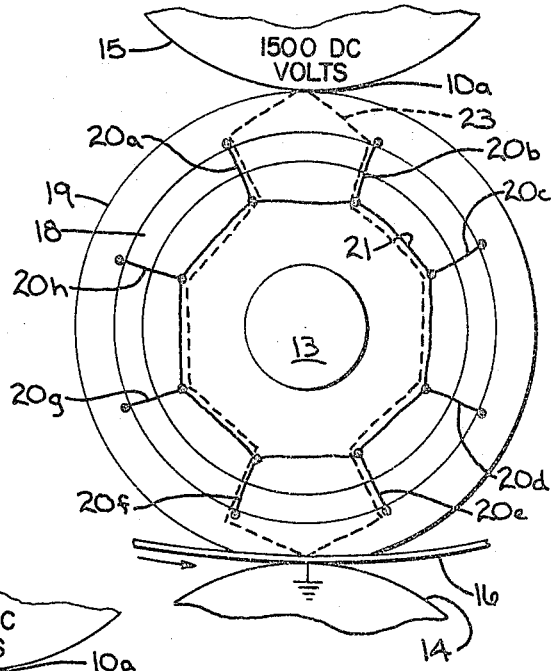
FIG.4
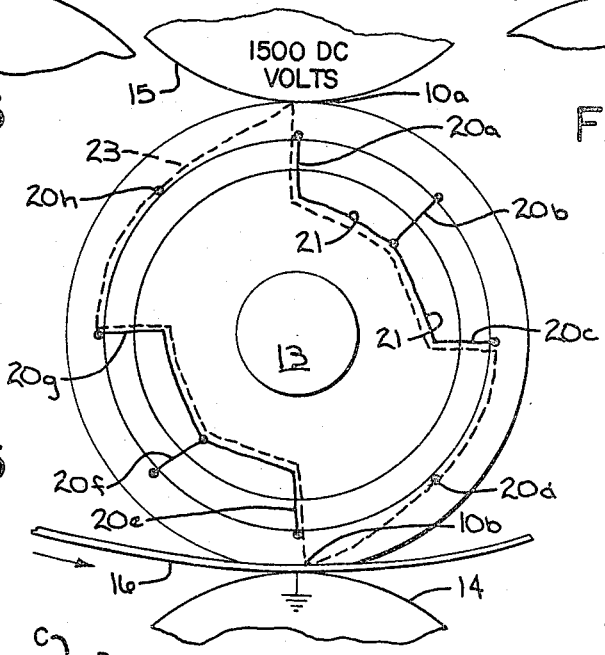
FIG.5
FIG.6
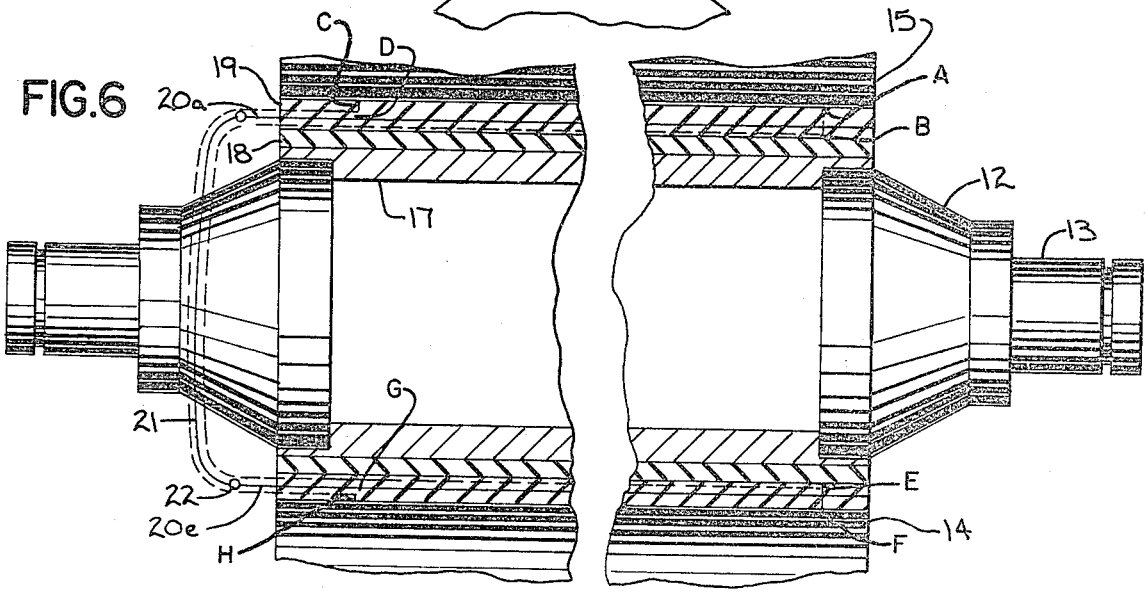

IMPRESSION ROLLER WITH ADJUSTABLE ELECTRICAL CHARACTERISTICS AND METHOD OF MAKING THE SAME

BACKGROUND OF THE INVENTION

The present invention relates to an impression roller for an electrostatically assisted printing machine.

Printing machines have been developed in which the transfer of ink to a web of material, such as paper, is not only provided by direct transfer of ink from an engraved cylinder, but also by electrostatic attraction of ink to the web. This is accomplished by passing the web through a nip region where the underside of the web is contacted by the engraved cylinder as it is being pressed down against the cylinder by an impression roller, which in turn is urged downward by hydraulic means. Transfer of the ink is assisted by applying an electrical voltage in the nip region in a pattern determined by the engraved cylinder. In machines where a backup roller contacts the impression roller in an area halfway around its circumference from the nip region, a voltage may be conveniently applied to the impression roller at that point and conducted through it to the engraved cylinder which is at ground potential.

Impression rollers of the type suitable for use in such a machine have typically been formed around a steel core that is grounded and insulated from the semiconductive layer that is formed on the exterior of the roller to conduct current to the nip region. The material used in the outer layer of the impression roller exhibits the resistance of a semiconductor, and is also resilient, which allows for flattening of the outer surface of the impression roller in the nip region.

SUMMARY OF THE INVENTION

The invention is embodied in an impression roller of adjustable resistance and is practiced in a method of making such a roller. Given a semiconductive resilient material that exhibits a variation in resistivity over its mechanical life, the invention teaches that a plurality of conductive elements can be added to such a roller and adapted for interconnection to adjust the resistance of the roller in several steps during its mechanical life to maintain the resistance of the roller within an acceptable range despite a change in the resistivity of the material in the semiconductive layer.

More particularly, the invention is demonstrated in an impression roller for conducting current from a first region of a relatively higher electrical potential to a second region of relatively lower electrical potential that is displaced around a portion of the circumference of the roller from the first region. The roller has a body that includes an insulated cylindrical core and a layer of semiconductive material around the insulated core. A set of conductive elements are disposed around the outside of the insulated core and in contact with the semiconductive material. Each conductive element has an electrical resistance of at least two orders of magnitude less than the layer of semiconductive material. The conductive elements have termination portions and means are provided for connecting the termination portions of selected conductive elements so that current bypasses portions of the layer of semiconductive material as such current is conducted from the first region to the second region.

It is one object of the invention to provide an impression roller of adjustable resistance to allow utilization of the roller throughout its mechanical life.

It is another object of the invention to provide a principle of roller construction that will be useful in various applications where it would be desirable to control the electrical properties of the covering, for example, electrostatic printing and copying.

It is another object of the invention to allow the adjustment of the resistance of an impression roller within an operating range in view of other parameters that may be adjustable or present in a particular printing machine.

The foregoing and other objects and advantages of the invention will appear from the following description in which reference is made to the accompanying drawings to form a part hereof, and in which there is shown by way of illustration a preferred embodiment of the invention. This embodiment does not necessarily represent the full scope of the invention, however, and therefore reference is made to the appended claims for interpreting the scope of the invention.

BRIEF DESCRIPTION OF THE DRAWINGS

FIG. 3 is a first schematic view of a section of the printing machine roller of FIGS. 1 and 2 in its operating environment;

FIG. 4 is a second schematic view of the same section of the printing machine roller after it has been rotated 22.5 degrees from its position in FIG. 3;

FIG. 5 is a third schematic view of the same section of the printing machine roller as FIGS. 3 and 4, with certain of its conductive elements being left unconnected;

FIG. 6 is a schematic view of a longitudinal section of the printing machine roller taken in plane indicated by line 6—6 in FIG. 1.

DESCRIPTION OF THE PREFERRED EMBODIMENT

Figure 1:
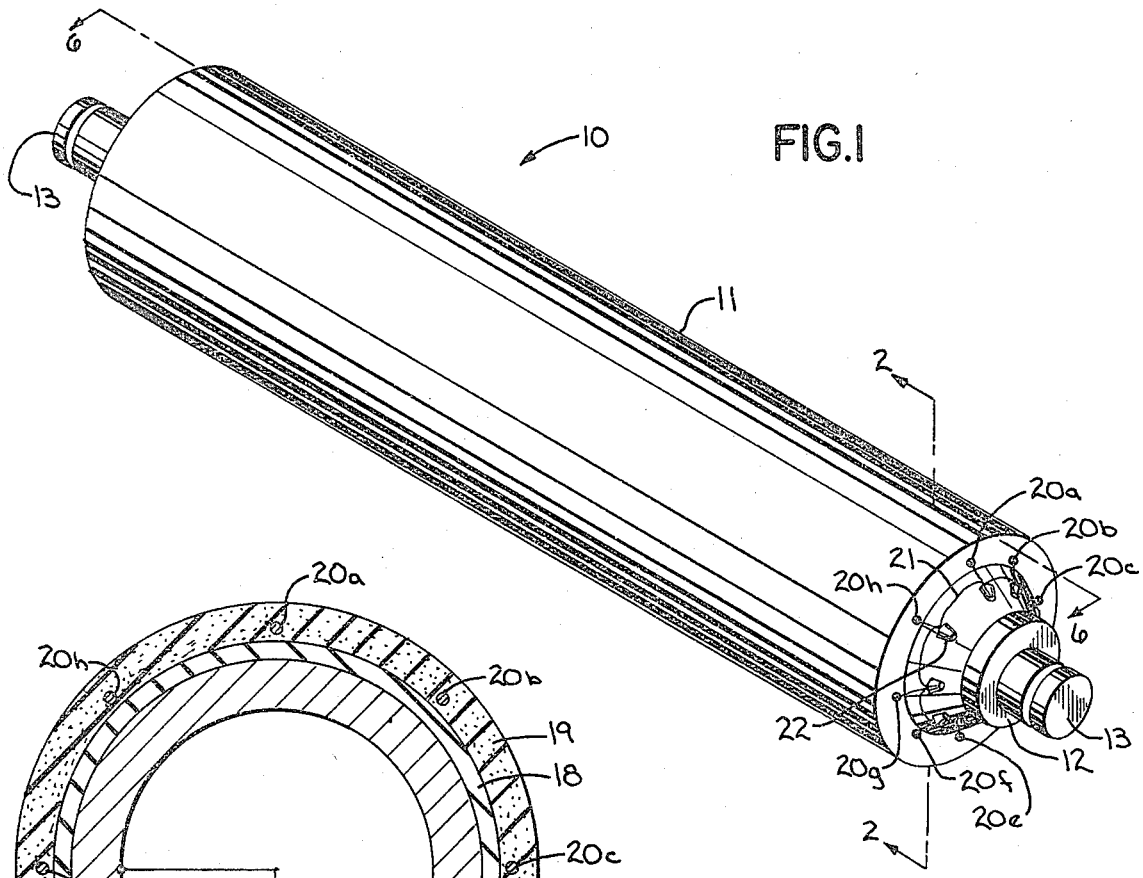
FIG. 1 is a perspective view of a printing machine roller of the present invention.

Referring to FIG. 1, the present invention is embodied in an impression roller 10 for use in a printing machine (not shown). The roller 10 has an elongated, cylindrical body 11 that is closed on its opposite ends by hubs 12. A pair of journal shafts 13 extend from the hubs 12 on opposite ends to be received in bearings in the printing machine.

A printing machine of the type in which such a roller 10 may be employed is described in Adamson et al, U.S. Pat. No. 3,477,369, issued Nov. 11, 1969. As described there and as represented schematically in FIGS. 3–5, the impression roller 10 is journaled in bearings for rotation between an engraved printing cylinder 14 and a backup roller 15 that is also journaled in respective bearings for rotation. Printed matter is transferred to a web 16 of a material such as paper, paperboard, fabric, plastic film or a laminate, by feeding the web 16 through a nip region **10*b* where the impression roller 10 and the engraved cylinder 14 bear upon each other through the web 16. The printed matter is transferred both by directly impressing and by electrostatically attracting ink from the cylinder 14 to the web 16 in a pattern determined by the engraved pattern on the cylinder 14. The present invention is related to characteristics of an impression roller 10 which affect the electrostatic attraction of ink to the web 16**.

Figure 2:
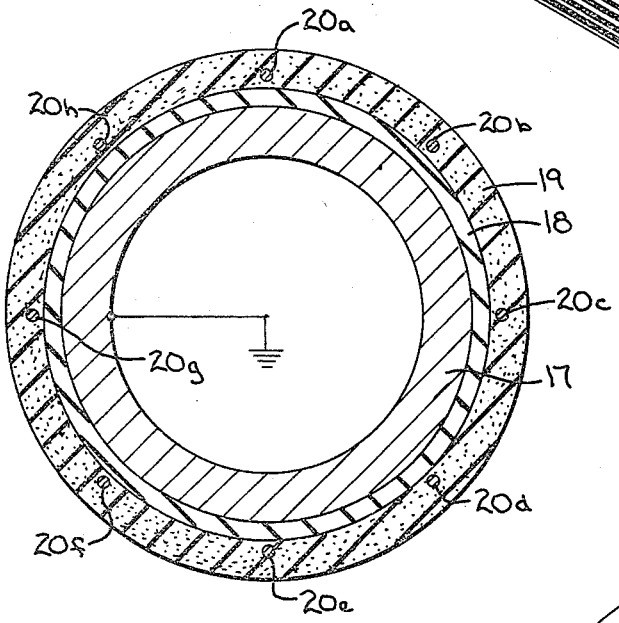
FIG. 2 is a sectional view of the roller of FIG. 1.

Referring to FIGS. 2 and 6, the impression roller 10 has a tubular core 17 that is preferably made of metal. The core 17 has an outside diameter of $5\frac{1}{2}$ inches, while the outside diameter of the roller is 7 inches. The core 17 is insulated by covering it with an inner layer 18 of insulating material of $\frac{1}{4}$ inch thickness to separate the core 17 from an outer layer 19 of semiconductive material that is $\frac{1}{2}$ inch in thickness. The insulating material is preferably either natural or synthetic rubber or a mixture of these, but other known insulating materials can also be used. The preferred material in the outer layer 19 is resilient and has an electrical resistivity in a range from $10^3$ ohm-centimeters to $10^8$ ohm-centimeters and a relative hardness in the range from 60–95 according to the Shore A scale. A chlorinated synthetic elastomer such as epichlorohydrin is suitable for use in forming the semiconductive layer 19. In addition, other semiconductive materials, including natural or synthetic materials, that exhibit the above described electrical characteristics, can also be employed. Furthermore, while resilient materials are preferred, in some applications non-resilient materials can also be used.

Still referring to FIGS. 1, 2 and 6, the roller 10 includes a set of conductive elements 20*a*–20*h* extending longitudinally from one end to the other, and as seen in FIG. 2, the elements 20*a*–20*h* are spaced radially from the central longitudinal axis of the roller 10. This radial distance is slightly greter than the radius of the interior boundary between the inner layer 18 of insulating material and the outer layer 19 of semiconductive material. The conductive elements 20*a*–20*h* are embedded in the outer layer 19 and equally spaced around the boundary between the two layers 18 and 19 to define a circle concentric therewith. Referring to FIG. 1, the conductive elements 20*a*–20*h* in this embodiment are metal wires having ends that extend out one end of the roller 10 and are connected by jumpers 21 and electrical connectors 22 in any of several arrangements to be described.

Referring to FIG. 3 in a typical arrangement with a backup roller 15 and an engraved printing cylinder 16 as described above, a d.c. voltage of 1500 volts is supplied through the backup roller 15. This voltage is supplied to a first region 10*a* of the outer surface of the semiconductive layer 19 and conducted to a second region 10*b* on the impression roller 10 that defines the nip region. The engraved cylinder 16 is grounded as is the frame of the printing machine so that a current will be transmitted through the impression roller 10 and through the portion of the web 16 passing through the nip region 10*b*. A suitable range for current in the nip region 10*b* is from 0.5 to 3 milliamperes. A new impression roller, without the conductive elements described above, typically has a resistance between 500 kilo-ohms and 1500 kilo-ohms, thereby providing an operating current in the desired range. As the roller 10 is used over a period of time, however, the outer layer 19 of semiconductive material experiences deterioration in its electrical characteristics to a relatively greater degree than it experiences mechanical wear. The result is that after several months of usage, the resistance of the semiconductive outer layer 19 begins to approach 3000 kilo-ohms, thereby requiring a much higher voltage through the backup roller 15 to maintain a current that is suitable for electrostatically assisted printing. It will be seen that the present invention provides a roller with an adjustable resistance, so that as the resistivity of the semiconductive outer layer increases with use, the resistance of the roller 10 can be decreased in steps by connecting the conductive elements 20*a*–20*h*. Where use of the roller 10 results in a decrease in resistivity, selected conductive elements can be connected before the roller is used and then disconnected as required to increase the overall resistance of the roller 10 in steps.

Referring to FIG. 3, it will be seen that with all eight conductive elements 20*a*–20*f* connected at one end of the roller 10, and with conductive element 20*a* positioned directly beneath the first region where the backup roller 15 and the impression roller 10 make contact, and with conductor 20*e* positioned 180 degrees around an arc from element 20*a*, the operating current (represented by dotted line 23) will be conducted through the semiconductive outer layer 19 for a distance equal to twice its thickness. After the current passes from the backup roller 15 through a first thickness, it is conducted through element 20*a* and the jumpers 21 to element 20*e* and then passes through a second thickness of the outer layer 19. Other conductors 20*b*–20*d* and 20*f*–20*h* provide a similar result as they are rotated into the positions of conductors 20*a* and 20*e*, respectively. Without the conductive elements 20*a*–20*h*, current would flow approximately half the mean arcuate length of the semiconductive layer as indicated by the dotted line 24 in FIG. 3.

Although the resistivity of the preferred conductive elements 20 is less than 1 ohm per ten feet of wire which in ohm centimeters is approximately six orders of magnitude less than the resistivity of the preferred semiconductive material, the present invention is applicable to embodiments where the conductive elements 20*a*–20*h* provide a negligible resistance when compared with the resistance through twice the thickness of the semiconductive layer 19. For purposes of this description wherever the resistance through a conductive element 20 is less than 1% of the resistance through the semiconductive layer 19 it will be considered to be negligible.

Referring to FIG. 4, it can be seen that some variation in the effective resistance of the impression roller 10 will be experienced when conductors 20*a* and 20*e* are not aligned along a diameter from the source voltage region 10*a* to the nip region 10*b*. This variation is tolerable, however, provided that the effective resistance of the roller 10 and the operating current are kept within a suitable range. This variation is also limited as the speed of rotation of the roller 10 is increased, and as the number of conductive elements is increased. In other embodiments of the invention, an odd number of conductive elements 20 might be employed to reduce this variation.

Referring to FIG. 6, it is also necessary to consider the path of current from points near and remote to the end of the roller 10 at which the jumpers 21 connect the conductive elements 20*a*–20*f*. With conductive elements 20*a*–20*h* of negligible resistance as defined above, the added resistance to current traveling from point A to point F via B and E will also be negligible in comparison with current traveling from point C to point H via D and G. Any resistance provided by the conductors 20*a*–20*h* can be further reduced by connecting the conductive elements 20 at both ends of the roller 10.

Referring to FIG. 5, it can be seen that when conductive elements 20*d* and 20*h* are not connected by jumper wires 21 and when the conductive elements 20*a*–20*h* of the impression roller 10 are positioned the same as in FIG. 3, the overall resistance of the roller 10 will be greater because the operating current will first travel along an arcuate portion of a circumferential path through the semiconductive layer 19 before bypassing a second arcuate portion and being conducted through the jumper wires 21 connecting conductors 20*a*20*c* and 20*e*–20*g* respectively.

The invention thus teaches that the impression roller can be installed in a printing machine without connections between the conductive elements 20*a*–20*h*, or with connections between conductive elements to provide a resistance between a source of d.c. voltage and a grounded, engraved cylinder 14, and as the electrical property of resistivity of the semiconductive material 19 in the roller 10 changes over its mechanical life, connections between the conductive elements 20*a*–20*h* can be made or interrupted to adjust the resistance of the roller 10 in steps to maintain its resistance and the operating current within an acceptable operating range for that printing machine.

In making a roller 10 of the present invention, the core 17 is coated with a metal bonding agent and the insulating layer 18 is formed by applying one or more laminations of sheet stock that are steam vulcanized under pressure to form a unitary layer. The semiconductive layer 19 is also formed by applying sheet stock in successive laminations which are vulcanized individually or as a group or together with the insulating layer 18 to form a unitary body 11 for the roller 10. The conductive elements 20*a*–20*h* are positioned around the outside of the insulated core 17 in slots made in the innermost lamination of the semiconductive layer 19, and after this layer 18 has been vulcanized the conductive elements 20*a*–20*h* are embedded in the locations described earlier herein. The termination portions of the conductive elements 20*a*–20*h* are allowed to extend out of the outer layer 19 to be connected in a pattern that will allow current to flow between the higher potential region 10*a* and the nip region 10*b* while bypassing portions of the semiconductive layer 19 as seen in FIG. 5.

An additional, optional step is to enclose the connected termination portions, which limits access by the user. With this additional step, calibration of the roller is made at the manufacturing site by making the necessary connections. When, after use in the field, a roller does not provide the necessary current control, the roller can be returned to the manufacturer for adjustment through the making of additional connections or interruption of original connections, to bring the roller back within the specified range of performance. Switches can be installed between the termination portions of the conductive elements so that the connections need only be made and interrupted "electrically" without mechanically altering the roller. When the connections between the termination portions of the conductive elements 20*a*–20*h* are to be enclosed or sealed, the semiconductive layer 18 is formed to be shorter in length than the insulated core 17 so that portions of the roller that enclose the connections will not extend beyond the ends of the roller body 11. The roller body 11 typically extends a short distance beyond the end of the back-up roller 15 and the engraved cylinder 14 to provide non-contacting areas in which the connections between the conductive elements 20*a*–20*h* can be conveniently made and enclosed for their protection.

Figure 7:
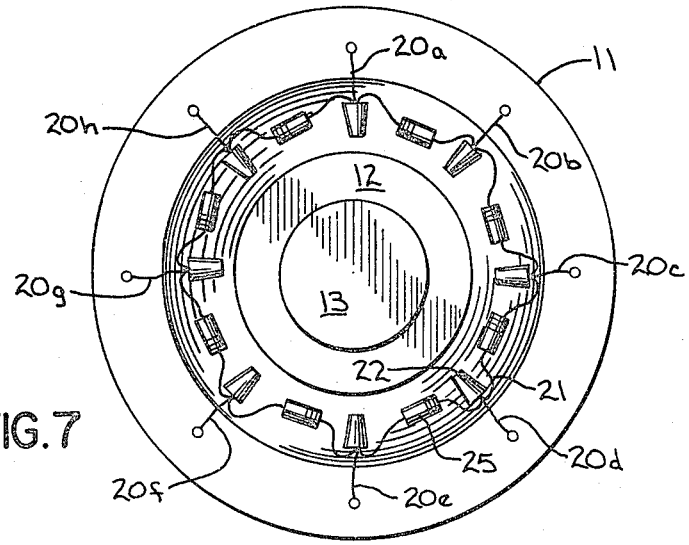
FIG. 7 is an end view of a second embodiment of the invention in which resistors are interconnected between the leads extending from the roller of FIG. 1.

Referring to FIG. 7, additional steps in adjusting the resistance of the roller 10 may be provided by connecting resistors 25 of various values between the electrical conductive elements instead of jumper wires 21 of negligible resistance.

Thus, the character of the roller 10 is changed from that of a single conductive object to a plurality of conductive segments, with the preferred embodiment showing one way of dividing the roller into such segments. In FIGS. 3–5, the connection of any two adjacent conductive elements bypasses one of these segments. Non-adjacent conductive elements can also be connected to bypass multiple segments. It should be apparent from the above description that the roller may be divided into segments in different ways by positioning the conductive elements 20*a*–20*h* differently in other embodiments. Similarly, it will also be apparent that the number and type of conductive elements may vary. For example, the conductive elements can be conductive rubber strips, or can be metalized elements formed on the outer surface of the insulating layer 18 using circuit board manufacturing techniques. The invention is also applicable to three layer rollers wherein a conductive layer is disposed between the semiconductive layer and the insulating layer, providing that some non-negligible resistance is provided by the conductive layer as current is conducted from region 10*a* to region 10*b*. The invention could be used to adjust resistance in such a roller although within a more limited range than in the two layer roller seen in FIGS. 1–7.

Accordingly, the scope of the invention has been reserved for the following claims.

I claim:

1. A machine roller for conducting current from a first region of relatively higher electrical potential to a second region of relatively lower electrical potential that is displaced around a portion of the circumference of the roller from the first region, the roller comprising:

a body including an insulated cylindrical core and a layer of semiconductive material extending around the insulated core to provide first and second regions of electrical potential when current is conducted through the roller;

a set of conductive elements disposed around the outside of the insulated core and contacting the semiconductive layer beneath the outer surface thereof, each conductive element having an electrical resistance of at least two orders of magnitude less than the electrical resistance through twice the thickness of the layer of semiconductive material, the conductive elements having respective termination portions; and means for connecting the termination portions of the conductive elements to form a parallel electrical path for a portion of the current that bypasses portions of the layer of semiconductive material as current is conducted from the first region of the roller to the second region.

2. The machine roller of claim 1, wherein:

the roller is formed along a longitudinal axis; and wherein the conductive elements extend along a portion of the length of the roller, are radially spaced from the longitudinal axis, and are arcuately spaced from each other.

3. The machine roller of claim 2, wherein the conductive elements are wires.

4. The machine roller of claim 2, wherein the conductive elements are equally spaced around the circumference of the roller.

5. The machine roller of claim 1, wherein the layer of semiconductive material has a resistivity within a range from $10^3$ ohm-centimeters to $10^8$ ohm-centimeters inclusive.

6. The machine roller of claim 1, wherein the connecting means includes an electrical component having a resistance within an order of magnitude of the resistance through a single thickness of the semiconductive layer of material.

7. The machine roller of claim 6, wherein the electrical component is a resistor.

8. A method of making a roller for controlling the amount of current that is conducted from a first region of relatively higher electrical potential to a second region of relatively lower electrical potential that is displaced around a portion of the circumference of the roller from the first region, the method comprising the steps of:

positioning a set of conductive elements around the insulated core to cover the conductive elements excepting the termination portions, wherein the layer of semiconductive material is distributed between the first and second regions and wherein each conductive element has an electrical resistance of at least two orders of magnitude less than the electrical resistance through twice the thickness of the layer of semiconductive material; and connecting the termination portions of selected conductive elements to determine a portion of the current that bypasses portions of the layer of semiconductive material as current is conducted from the first region to the second region, whereby the roller is adjustable to control current between the first and second regions.

9. The method of claim 8, further comprising the step of electrically disconnecting previously connected termination portions of selected conductive elements to decrease the amount of current that is conducted between the first region and the second region of the roller.

* * * * *